US007895994B2

(12) United States Patent
Yamada et al.

(10) Patent No.: US 7,895,994 B2
(45) Date of Patent: Mar. 1, 2011

(54) IGNITION DEVICE FOR PLASMA JET IGNITION PLUG

(75) Inventors: Yuichi Yamada, Aichi (JP); Daisuke Nakano, Aichi (JP); Toru Nakamura, Aichi (JP); Yoshikuni Sato, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 12/407,955

(22) Filed: Mar. 20, 2009

(65) Prior Publication Data

US 2009/0235889 A1 Sep. 24, 2009

(30) Foreign Application Priority Data

Mar. 21, 2008 (JP) ..... P2008-073103

(51) Int. Cl.
*F02P 3/00* (2006.01)
*F02P 23/04* (2006.01)

(52) U.S. Cl. ..... 123/618; 123/143 B

(58) Field of Classification Search ..... 123/618, 123/143 B

See application file for complete search history.

(56) References Cited

U.S. PATENT DOCUMENTS 6,321,733 B1 * 11/2001 Suckewer et al. ..... 123/620
6,474,321 B1 * 11/2002 Suckewer et al. ..... 123/620
7,305,954 B2 * 12/2007 Hagiwara et al. ..... 123/143 B
7,328,677 B2 * 2/2008 Hagiwara et al. ..... 123/143 B
7,387,115 B1 * 6/2008 Katoh et al. ..... 123/620
2008/0121200 A1 * 5/2008 Kato et al. ..... 123/143 B
2008/0141967 A1 * 6/2008 Tani et al. ..... 123/143 B
2009/0007893 A1 1/2009 Kato et al. ..... 123/596

FOREIGN PATENT DOCUMENTS

JP 57028869 2/1982
JP 2009030593 2/2009

* cited by examiner

*Primary Examiner*—Hai H Huynh
(74) *Attorney, Agent, or Firm*—Kusner & Jaffe

(57) ABSTRACT

An ignition device for a plasma jet ignition plug is provided. A resistance for decreasing electric noises is not incorporated in a plasma jet ignition plug. A resistance of not less than 1KΩ and not more than 20KΩ is provided to a path from a spark discharge circuit to a center electrode, thus reducing the generation of electric noises at the time of trigger discharge. Along with the reduction of the generation of electric noises, a loss of energy at the time of plasma discharge can be reduced by setting an inner resistance provided to a line extending to the center electrode from a plasma discharge circuit to 1Ω or less. Accordingly, the plasma jet ignition plug can jet flame-shaped plasma sufficiently large for igniting an air-fuel mixture.

5 Claims, 9 Drawing Sheets

IGNITION DEVICE FOR PLASMA JET IGNITION PLUG

FIELD OF THE INVENTION

The present invention relates to an ignition device for a plasma jet ignition plug of an internal combustion engine which performs ignition of an air-fuel mixture by forming plasma.

BACKGROUND OF THE INVENTION

For generating ignition in an engine, for example, an internal combustion engine of an automobile, a spark plug has been used to ignite an air-fuel mixture by spark discharge (also simply referred to as "discharge"). Recently, the internal combustion engine is required to satisfy high output and low fuel consumption. A plasma jet ignition plug has been known as an ignition plug having a high ignition property which exhibits fast spreading of combustion and can ignite a lean air-fuel mixture having a higher ignition limit air fuel ratio.

In such a plasma jet ignition plug, a spark discharge gap is formed between a center electrode and a ground electrode when the plasma jet ignition plug is used in a state that the plasma jet ignition plug is configured such that a periphery of the spark discharge gap is surrounded by an insulator made of ceramics, thus forming a discharge space having a small volume that is referred to as a cavity. The plasma jet ignition plug will be explained by taking a plasma jet ignition plug which uses a superimposed-type power source as one example. For example, at the time of igniting the air-fuel mixture, a high voltage is applied between the center electrode, and the ground electrode thus generating spark discharge (also referred to as "trigger discharge"). Due to the dielectric breakdown which is generated in such spark discharge, an electric current of relatively low voltage flows between the center electrode and the ground electrode. Then, by further supplying energy between the center electrode and the ground electrode, a discharge state is changed so as to form plasma in the cavity. Then, by allowing the formed plasma to be jetted through a communication hole (so-called orifice), the ignition of air-fuel mixture is performed. From a viewpoint of jetting of plasma, this stroke corresponds to one stroke.

Japanese unexamined patent application publication No. JP-A-S57-28869 describes a related art plasma jet ignition plug. In the related art plasma jet ignition plug, at the time of forming plasma, it is necessary to set the electric current which flows into the spark discharge gap to an amount that is larger than an amount of electric current which flows for spark discharge in a general spark plug. To increase an amount of electric current which flows into the spark discharge gap, it is necessary to decrease an electric resistance value on a circuit in which the electric current flows, and hence, a resistor is usually not provided on a circuit of an ignition device or in the inside of the plasma jet ignition plug.

SUMMARY OF THE INVENTION

A large amount of electric current flows into the plasma jet ignition plug in a short time and hence, there is a sharp fluctuation of the electric current value per unit time, thus giving rise to a drawback that large electric noises might be generated. When a resistor is simply provided in the inside of the plasma jet ignition plug or on the circuit of the ignition device to suppress the generation of such electric noises, there exists a possibility that energy sufficiently large for forming plasma cannot be obtained.

The present invention has been made to overcome the above-mentioned disadvantage, and it is an aspect of the present invention to provide an ignition device for a plasma jet ignition plug which can suppress the generation of electric noises, while allowing an electric current sufficiently large for forming plasma to flow into a spark discharge gap at the time of igniting an air-fuel mixture by the plasma jet ignition plug.

According to an illustrative aspect of the present invention, there is provided an ignition device for a plasma jet ignition plug which is configured to apply a voltage to the plasma jet ignition plug in which a cavity is formed surrounding a periphery of at least a portion of a spark discharge gap formed between a center electrode and a ground electrode so as to form a discharge space. Plasma formed in the cavity is jetted from an opening formed in the cavity along with spark discharge generated in the spark discharge gap. The ignition device comprises: a discharge voltage applying unit that is configured to apply a voltage for generating the spark discharge caused by dielectric breakdown in the spark discharge gap to the plasma jet ignition plug; and an energy supplying unit that is configured to supply energy to the spark discharge gap for forming the plasma along with the spark discharge generated by the application of the voltage using the discharge voltage applying unit, wherein a resistor is arranged between the plasma jet ignition plug and the discharge voltage applying unit so as to set an electric resistance value between the plasma jet ignition plug and the discharge voltage applying unit to not less than 1KΩ and not more than 20KΩ, and an electric resistance value between the plasma jet ignition plug and the energy supply unit is set to not more than 1Ω.

According to the above described ignition device for the plasma jet ignition plug, at the time of ignition, a large voltage is instantaneously applied to the spark discharge gap from the discharge voltage applying unit, thus generating dielectric breakdown in the spark discharge gap. Although a large amount of electric current rapidly flows into the spark discharge gap at the time of dielectric breakdown, the resistor having an electric resistance value of not less than 1KΩ and not more than 20KΩ is arranged between the discharge voltage applying unit and the spark discharge gap. Hence, it is possible to suppress the generation of electric noises at the time of dielectric breakdown.

After the dielectric breakdown, energy for forming plasma is supplied from the energy supply unit so as to allow an electric current to flow into the spark discharge gap. Although it is necessary to allow a large amount of electric current to flow into the spark discharge gap for forming plasma, the electric resistance value between the energy supply unit and the spark discharge gap is set to not more than 1Ω. Accordingly, a loss of energy for forming plasma between the energy supply unit and the spark discharge gap is small. Therefore, an amount of electric current which flows into the spark discharge gap is hardly suppressed, thus enabling the jetting of a flame-shaped plasma having sufficient energy for ignition of an air-fuel mixture.

BRIEF DESCRIPTION OF THE DRAWINGS

Illustrative aspects of the invention will be described in detail with reference to the following figures wherein.

DETAILED DESCRIPTION OF THE INVENTION

Figure 1:
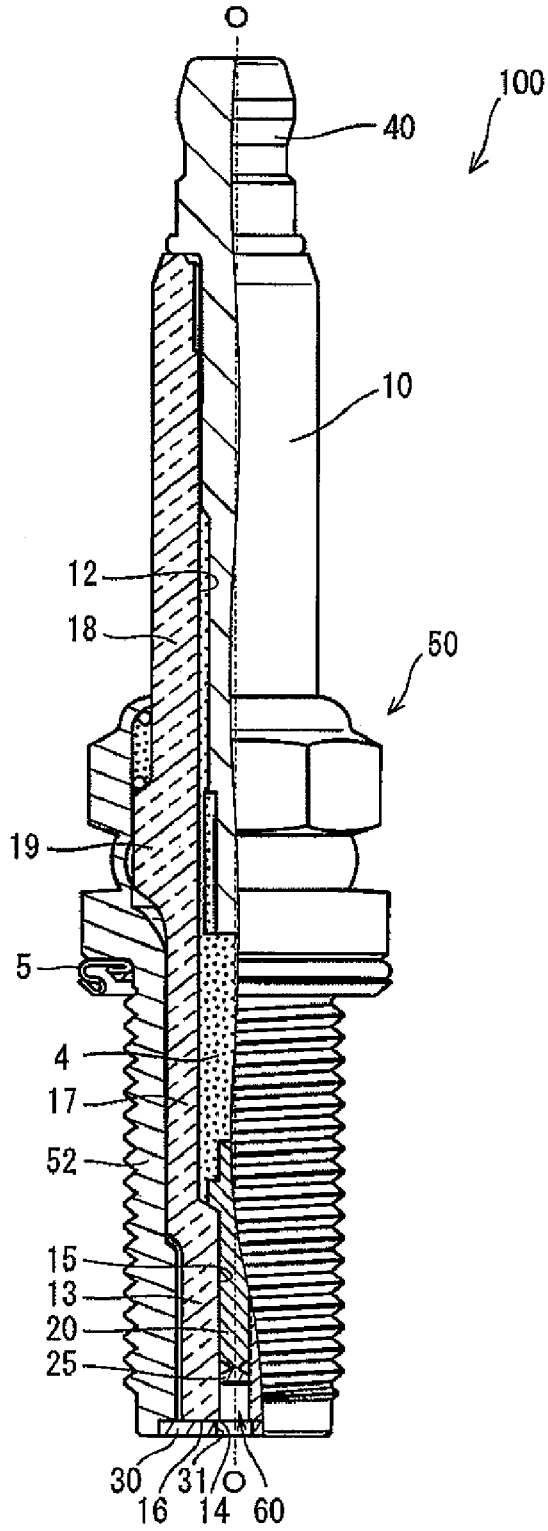
FIG. 1 is a partial cross-sectional view of a plasma jet ignition plug 100.

Hereinafter, one exemplary embodiment of an ignition device for a plasma jet ignition plug which embodies the present invention is explained in conjunction with the drawings. The structure of the plasma jet ignition plug 100, whose ignition is controlled by the ignition device 200 according to the present invention, is explained with reference to FIG. 1. FIG. 1 is a partial cross-sectional view of the plasma jet ignition plug 100. In FIG. 1, a direction of an axis O of the plasma jet ignition plug 100 is set as a vertical direction in the drawing, a lower side of the plasma jet ignition plug 100 constitutes a leading end side of the plasma jet ignition plug 100, and an upper side of the plasma jet ignition plug 100 constitutes a rear-end side of the plasma jet ignition plug 100.

The plasma jet ignition plug 100 shown in FIG. 1 includes a cylindrical insulator 10 which is an insulation member formed by baking alumina or the like and forms an axial hole extending in the axis O direction therein. The insulator 10 has a middle barrel portion 19 having a largest outer diameter at the approximate center in the axis O direction. On a rear end side of the middle barrel portion 19, a rear-end-side barrel portion 18 having an outer diameter smaller than the outer diameter of the middle barrel portion 19 is formed such that the rear-end-side barrel portion 18 extends toward a rear end side in the axis O direction (toward an upper side in FIG. 1). Further, on a leading end side (a lower side in FIG. 1) with respect to the middle barrel portion 19, a leading end-side barrel portion 17 having an outer diameter smaller than an outer diameter of the rear-end-side barrel portion 18 is formed. Further, on a leading end side with respect to the leading end-side barrel portion 17, a leg portion 13 having an outer diameter smaller than the outer diameter of the leading end-side barrel portion 17 is formed, and a portion of the axial hole 12 formed in the insulator 10, which corresponds to an inner periphery of the leg portion 13, has a diameter smaller than diameters of other portions of the axial hole 12, thus forming an electrode accommodating portion 15. An inner periphery of the electrode accommodating portion 15 is contiguously formed with a leading end surface 16 of the insulator 10, thus forming an opening 14 of a cavity 60 described below.

In the inside of the electrode accommodating portion 15, a rod-shaped center electrode 20 is held. Center electrode 20 is comprised of a core member made of copper or copper alloy and an outer skin made of Ni alloy. On a leading end of center electrode 20, a disk-shaped electrode chip 25, made of alloy containing noble metal or W as a main content, is bonded such that the electrode chip 25 is integrally formed with the center electrode 20. In this embodiment, the center electrode 20 including the electrode chip 25 which is integrally formed with the center electrode 20 is referred to as "center electrode". A discharge space having a small volume is formed such that the discharge space is surrounded by a leading end surface of the center electrode 20 (to be more specific, a leading end surface of the electrode chip 25 which is integrally bonded to the center electrode 20) and an inner peripheral surface of the electrode accommodating portion 15 of the axial hole 12. In this embodiment, this discharge space is referred to as the cavity 60. Further, the center electrode 20 extends in the axial hole 12 toward a rear end side, and is electrically connected with a terminal metal fixture 40 which is formed on the rear end side of the axial hole 12 via a conductive sealing body 4 made of a mixture comprising metal and glass. A high voltage cable (not shown in the drawing) is connected to the terminal metal fixture 40 via a plug cap so as to allow the ignition device 200 (see FIG. 2), described below, to apply a high voltage to the plasma jet ignition plug 100.

Further, the insulator 10 has a periphery of a portion thereof ranging from a portion of a rear-end-side barrel portion 18 to the leg portion 13 surrounded by a metal shell 50 which is formed in a cylindrical shape using an iron-based material, and is held on the metal shell 50 by caulking. The metal shell 50 is a fitting for fixing the plasma jet ignition plug 100 to an engine head of the internal combustion engine in the drawing and has a mounting threaded portion 52 provided with threads to be threadedly engaged with a mounting hole of the engine head. Further, an annular gasket 5 is fitted on a proximal end side of the mounting threaded portion 52 by insertion for preventing leaking of a gas from the inside of the engine by way of the mounting hole when the plasma jet ignition plug 100 is mounted in the mounting hole of the engine head.

Next, a disc-shaped ground electrode 30 is mounted on a leading end of the metal shell 50. Ground electrode 30 is formed using an Ni-based alloy that exhibits excellent spark wear resistance, such as Inconel 600 or 601 (trademark). The ground electrode 30 has a thickness direction thereof arranged in the axis O direction, and is integrally bonded to the metal shell 50 such that the ground electrode 30 is brought into contact with a leading end surface 16 of the insulator 10. A communication hole 31 is formed in a center portion of the ground electrode 30, and is arranged coaxially and contiguously with the opening 14 of the cavity 60. The inside and the outside of the cavity 60 are communicated with each other through the communication hole 31. A spark discharge gap is formed between the ground electrode 30 and the center electrode 20, and the cavity 60 is formed so as to surround at least a periphery of a portion of the spark discharge gap. In performing the spark discharge in the spark discharge gap, energy is supplied to the spark discharge gap so that plasma is formed in the cavity 60, and plasma is jetted from the opening 14 by way of the communication hole 31.

Figure 2:
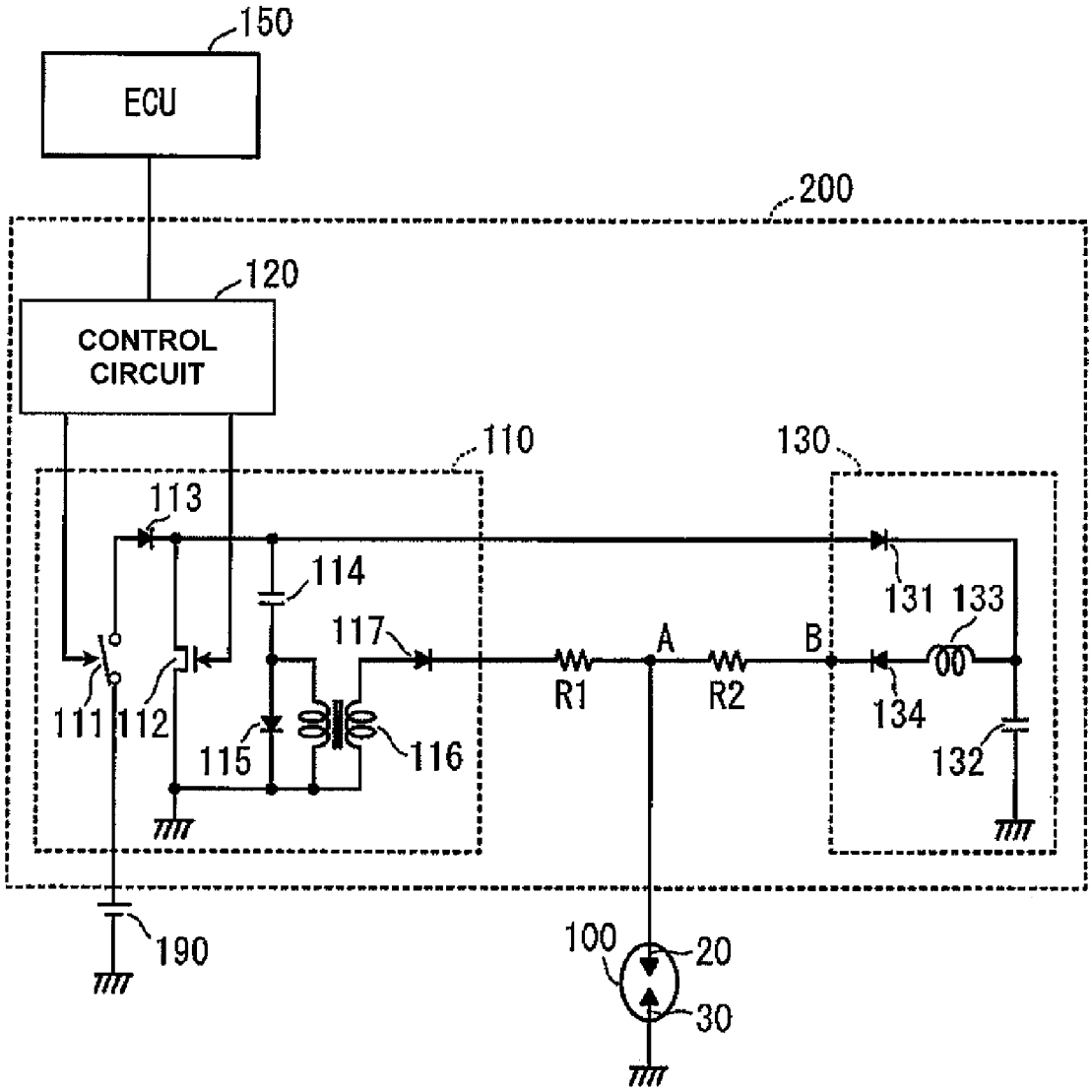
FIG. 2 is a view schematically showing the electrical circuit constitution of an ignition device 200.

In the plasma jet ignition plug 100 having such structure, by connecting the plasma jet ignition plug 100 to the ignition device 200 shown in FIG. 2, energy is supplied to the spark discharge gap and hence, plasma is formed in the inside of the cavity 60, whereby plasma is jetted from the opening 14 so as to perform the ignition of an air-fuel mixture. Hereinafter, in conjunction with FIG. 2, the ignition device 200 of the plasma jet ignition plug 100 is explained. FIG. 2 is a view schematically showing the electrical circuit comprising the ignition device 200.

The ignition device 200 shown in FIG. 2 is a device which generates spark discharge between the center electrode 20 and the ground electrode 30 of the plasma jet ignition plug 100, forms plasma by supplying energy to the spark discharge, and jets the formed plasma thus performing the ignition of an air-fuel mixture. The ignition device 200 includes a spark discharge circuit 110, a plasma discharge circuit 130, a control circuit 120, and an electric noises reducing resistance R1.

The spark discharge circuit 110 is a power source circuit which generates a spark discharge by causing dielectric breakdown by applying a high voltage to the spark discharge gap, that is, a power source circuit for performing a so-called trigger discharge. The spark discharge circuit 110 includes switches 111, 112 for a drive control, diodes 113, 115, 117 for preventing a reverse flow, a capacitor 114 which stores a charge used as energy for a spark discharge, and an ignition coil 116 for generating a high voltage. An anode of the diode 113 is connected to a high voltage side of a battery 190 of an automobile via the switch 111, and a cathode of the diode 113 is grounded via the switch 112 and, at the same time, is connected to one end of the capacitor 114 which stores electricity for a trigger discharge. Further, another end of the capacitor 114 is connected to an anode of the diode 115 and a primary-side one end of the ignition coil 116. Both a cathode of the diode 115 and a primary-side another end of the ignition coil 116 are grounded. A secondary side of the ignition coil 116 has one end thereof grounded and another end thereof connected to an anode of the diode 117. A cathode of the diode 117 is connected to the center electrode 20 of the plasma jet ignition plug 100 via a resistance R1 having an electric resistance value of not less than 1KΩand not more than 20KΩ. The ground electrode 30 of the plasma jet ignition plug 100 is grounded via the metal shell 50 (see FIG. 1). The spark discharge circuit 110 corresponds to "discharge voltage applying unit" of the present invention, and the resistance R1 corresponds to "resistor" of the present invention.

The plasma discharge circuit 130 is a power source circuit which, at the time of trigger discharge performed by the spark discharge circuit 110, forms plasma due to the transition of a discharge state with the supply of high energy to the spark discharge gap where the dielectric breakdown is generated. That is, plasma discharge circuit 130 is the power source circuit for performing a plasma discharge. The plasma discharge circuit 130 includes diodes 131, 134 for preventing a reverse flow, a capacitor 132 which stores a charge as energy for plasma discharge, and an inductor 133 which adjusts an electric current which flows into the spark discharge gap. An anode of the diode 131 is connected to a cathode of the diode 113 of the spark discharge circuit 110, a cathode of the diode 131 is grounded via the capacitor 132, and is also connected to one end of the inductor 133. Further, another end of the inductor 133 is connected to an anode of the diode 134, and a cathode of the diode 134 is connected to the center electrode 20 of the plasma jet ignition plug 100. An inner resistance R2 of the line B-A which connects the diode 134 and the center electrode 20 is set such that an electric resistance value becomes not more than 1Ω. Further, an electrostatic capacitance of the above-mentioned capacitor 132 is set such that energy at the time of forming plasma, that is, a sum of an amount of energy supplied from the capacitor 114 at the time of trigger discharge to the spark discharge gap and an amount of energy from the capacitor 132, assumes an amount supplied for performing the plasma jetting one time (for example, 150 mJ). The plasma discharge circuit 130 corresponds to "energy supply unit" of the present invention.

Driving and non-driving of the spark discharge circuit 110 and the plasma discharge circuit 130 are controlled by the control circuit 120. The control circuit 120 is connected with an electronic control device (ECU) 150 of an automobile. Based on an ignition instruction (reception of a control signal indicative of ignition timing) from the ECU 150, an ON/OFF control of the switch 111 and the switch 112 is performed. Based on such an ON/OFF control, charging/discharging of the capacitor 114 and the capacitor 132 is controlled so as to supply electricity to the plasma jet ignition plug 100, thus allowing the plasma jet ignition plug 100 to jet flame-shaped plasma and hence, the ignition of an air-fuel mixture is performed.

Figure 3:
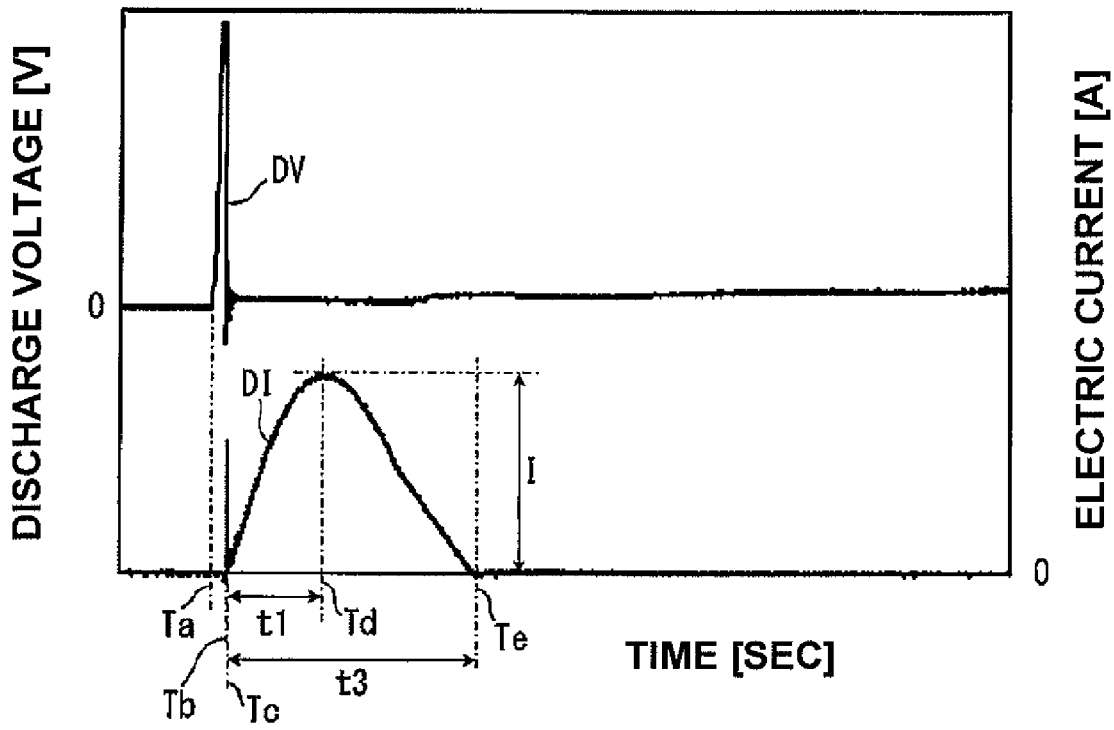
FIG. 3 is a graph in which an electric current DI, which flows into a spark discharge gap at the time of spark discharge, and a discharge voltage DV are measured at a position (point) A in FIG. 2.

Next, the manner of operation of the ignition device 200 at the time of performing ignition of the air-fuel mixture is explained in conjunction with FIG. 2 and FIG. 3. FIG. 3 is a graph which shows an electric current DI which flows into the spark discharge gap at the time of spark discharge and a discharge voltage DV measured at a position (point) A in FIG. 2.

When an internal combustion engine is operated and the ignition of the air-fuel mixture is performed by the plasma jet ignition plug 100 of this embodiment along with the operation of the engine, as shown in FIG. 2, information indicative of ignition timing is transmitted to the control circuit 120 of the ignition device 200 from the ECU 150. At a time prior to the ignition time (time Ta in FIG. 3), the switch 111 is controlled so as to assume an ON state so that the capacitor 114 of the spark discharge circuit 110 and the capacitor 132 of the plasma discharge circuit 130 are charged.

When the switch 112 is controlled so as to assume an ON state by the control circuit 120 based on information of ignition timing at time Ta (see FIG. 3), a charge stored in the capacitor 114 is discharged so that an electric current flows into a primary side of the ignition coil 116 and an induced electromotive force is generated on a secondary side of the ignition coil 116. Due to the generation of the induced electromotive force, a high voltage is applied to the spark discharge gap between the ground electrode 30 and the center electrode 20. Hence, a potential difference between a voltage at the point A and a ground voltage is sharply increased whereby dielectric breakdown is generated at time Tb (see FIG. 3), thus generating a spark discharge (trigger discharge). Although an electric current which flows at the point A is sharply increased by such a trigger discharge, due to the arrangement of the resistance RI on a path in which the electric current flows, the generation of electric noises is decreased. When the switch 111 is controlled so as to assume an OFF state or the trigger discharge is performed at the time of such a spark discharge, the switch 112 is also controlled so as to assume an OFF state.

When the insulation of the spark discharge gap is broken by the trigger discharge, it is possible to allow the flow of an electric current into the spark discharge gap with a potential difference (discharge voltage) lower than the potential difference at the time of the trigger discharge. At time Tc (see FIG. 3) substantially equal to time Tb, energy stored in the capacitor 132 starts to discharge and is supplied to the spark discharge gap. Since the sharp fluctuation of an amount of an electric current which flows at the point A is suppressed due to the inductor 133, an electric current value is gradually elevated and assumes a maximum value I [A] at time Td (see FIG. 3). Further, the sharp fluctuation of an amount of an electric current in the spark discharge gap can be suppressed and hence, it is possible to suppress the generation of electric noises.

Along with the supply of energy, a discharge state in the cavity 60 changes and plasma of high energy is formed. The plasma is guided by a shape of the cavity 60 while expanding in the cavity 60, and is jetted toward the inside of a combustion chamber from the opening 14 through the communication hole 31 formed in the ground electrode 30 in a flame shape extending in the axis O direction. An air-fuel mixture in the combustion chamber is ignited by the flame-shaped plasma. A flame kernel, which is formed by the ignition, grows and spreads in the combustion chamber leading to the combustion of the air-fuel mixture.

Along with the discharge of energy stored in the capacitor 132, after the electric current of the maximum value I flows at time Td, the electric current is gradually decreased. When an amount of electric current becomes small at time Te so that the supply of energy is finished, the spark discharge gap is insulated (see FIG. 3). Thereafter, the switch 111 is controlled so as to assume an ON state again, and the capacitor 114 and the capacitor 132 are again charged for the next ignition.

In this manner, the electric noises which may be discharged at the time of spark discharge of the plasma jet ignition plug 100 can be suppressed by the resistance R1 provided to the ignition device 200. There may be a case that the general-type spark plug incorporates a resistance for decreasing electric noises therein (usually the resistance being provided between a center electrode and a terminal metal fixture). However, as shown in FIG. 1, for decreasing a loss of energy at the time of plasma discharge, the plasma jet ignition plug 100 does not incorporate a resistance for decreasing electric noises therein. Accordingly, in this embodiment, the resistance R1 having an electric resistance value of not less than 1KΩ and not more than 20KΩ is arranged between the spark discharge circuit 110 and the plasma jet ignition plug 100 as shown in FIG. 2. Further, the electric resistance value of the inner resistance R2 of the line B-A which connects the plasma discharge circuit 130 and the plasma jet ignition plug 100 to each other is set to not more than 1Ω. Due to such constitution, it is possible to suppress the generation of electric noises which are caused due to the sharp fluctuation of an amount of electric current which flows into the spark discharge gap at the time of trigger discharge. At the time of plasma discharge, a loss of energy supplied to the spark discharge gap can be suppressed so that flame-shaped plasma sufficiently large for igniting the air-fuel mixture can be jetted. According to an example 1 described below, it is found that by setting the electric resistance value of the resistance R1 and the electric resistance value of the inner resistance R2 to such values, an electric current which is sufficiently large for forming plasma is allowed to flow into the spark discharge gap while suppressing the generation of electric noises. When the electric resistance value of the resistance R1 is larger than 20KΩ, it is difficult to generate the sufficient potential difference in the spark discharge gap at the time of trigger discharge and hence, there arises a possibility that the spark discharge cannot be performed.

The plasma discharge comes after the dielectric breakdown in the spark discharge gap is generated. Hence, the supply of an instantaneous large current, which is liable to generate electric noises, may not be necessary. However, to generate the transition of the discharge state, it is necessary to allow a large amount of electric current to flow into the spark discharge gap. Accordingly, in this embodiment, as an example of an electronic member which can suppress the sharp fluctuation of an amount of electric current, the inductor 133 is provided on a path which supplies energy to the spark discharge gap at the time of plasma discharge. Further, the supply state of energy to the spark discharge gap at the time of plasma discharge is prescribed.

To be more specific, as shown in FIG. 3, with respect to the relationship between the maximum value I[A] of an electric current DI which flows into the spark discharge gap at the time of plasma discharge that is started at time Tc and time period t1 [sec] which elapses until time Td at which the electric current DI assumes the maximum value I, it is prescribed that the value of I/t1 [A/sec], which indicates the fluctuation of an amount of electric current per unit time, satisfies the following formula (1).

$$I/t1 \leqq 2.5\times10^6\ [A/\text{sec}] \quad (1)$$

According to an example 2 described below, by suppressing the fluctuation of the current value per unit time to not more than $2.5\times10^6$ [A/sec], it is possible to sufficiently suppress the generation of electric noises.

Although the formula (1) may be easily satisfied, provided that the maximum value I of the electric current DI which flows into the spark discharge gap is small, in order to ensure the reliable ignition of an air-fuel mixture, it is prescribed that the following formula (2) is satisfied to prevent the size of jetted plasma from becoming small.

$$I \geqq 5\ [A] \quad (2)$$

According to the example 2 described below, when the maximum value I of the electric current which flows into the spark discharge gap at the time of plasma discharge is not less than 5 A, it is possible to jet flame-shaped plasma having a size sufficiently large for ignition of an air-fuel mixture.

Further, in this embodiment, it is also prescribed that time period t1, which elapses from starting of plasma discharge at time Tc to time Td at that the electric current which flows into the spark discharge gap assumes the maximum value I, satisfies the following formula (3).

$$t1 \leqq 75\ [\mu\text{sec}] \quad (3)$$

As described above, the smaller the fluctuation of the electric current value per unit time, the more generation of electric noises can be suppressed. However, to jet the flame-shaped plasma having a size sufficiently large for ignition of an air-fuel mixture, it is necessary to supply a large amount of energy to the spark discharge gap within a short time. To this end, the time period, which elapses from a point of time that plasma discharge is started to a point of time that the electric current that flows into the spark discharge gap assumes the maximum value I, is preferably short. According to an example 3 described below, it is found that t1 is preferably not more than 75 μsec.

Figure 4:
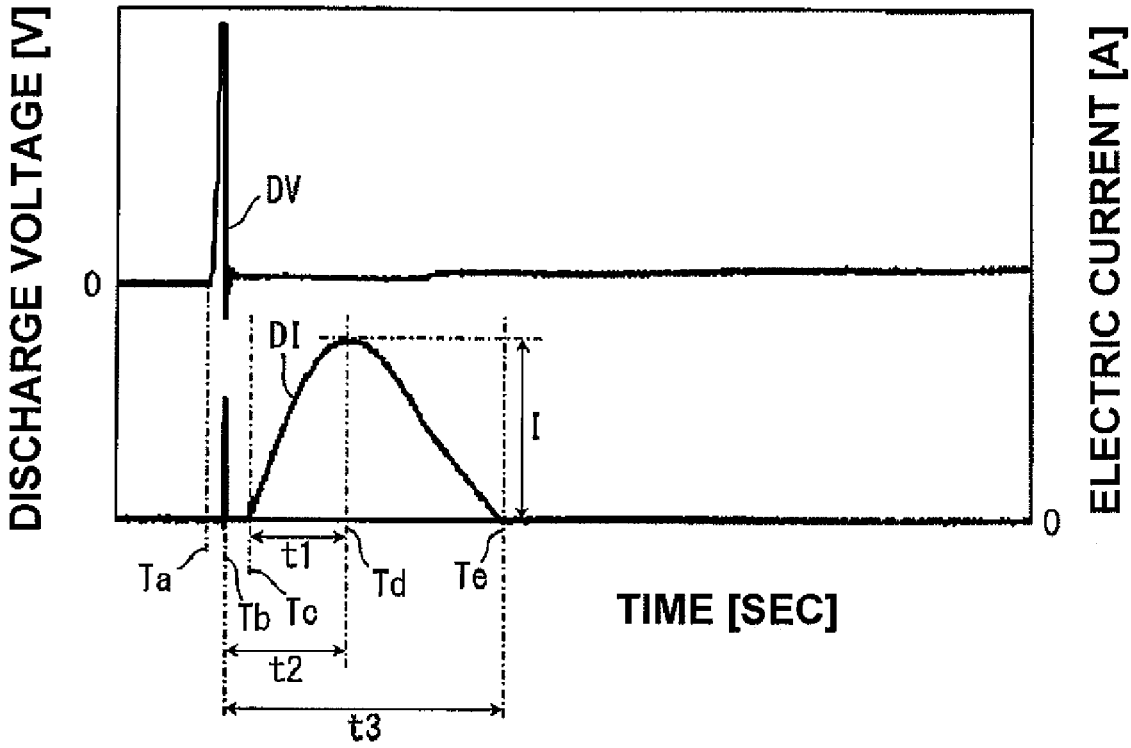
FIG. 4 is a graph in which an electric current DI, which flows into a spark discharge gap at the time of spark discharge, and a discharge voltage DV are measured at a position (point) A in FIG. 2.

Depending on a control mode of plasma discharge, there may be a case that the supply of energy to the spark discharge gap is started with a delay after the trigger discharge. To be more specific, as shown in FIG. 4, a control may be performed to cause a delay between time Tb at which the dielectric breakdown is generated by trigger discharge in the spark discharge gap and the time Tc at which an electric current for plasma discharge starts flowing. In such a case, when it takes time until the electric current which flows into the spark discharge gap to assume the maximum value I, an insulation resistance value which is lowered by dielectric breakdown at the time of spark discharge is elevated so that a loss of the supplied energy is increased. Accordingly, in this embodiment, using the dielectric breakdown in the spark discharge gap generated at time Tb as a start point, it is prescribed that time period t2 [sec] which elapses until time Td at which the electric current DI, which flows into the spark discharge gap at the time of plasma discharge, assumes the maximum value I satisfies a following formula (4).

$$t2 \leqq 150\ [\mu sec] \quad (4)$$

According to an example 4 described below, provided that t2 is not more than 150 μsec, energy for forming plasma is supplied in a relatively early period. Hence, a loss of energy can be suppressed whereby it is possible to jet flame-shaped plasma having a size sufficiently large for ignition of an air-fuel mixture.

Further, it is prescribed that a rate t1/t3 between time period t1[sec] which elapses until time Td at which the electric current which flows into the spark discharge gap assumes the maximum value I, and time period t3[sec] which elapses until time Te at which the supply of energy is finished from the start of plasma discharge at time Tc, satisfies the following formula (5).

$$t1/t3 \leqq 3/5 \quad (5)$$

The closer the rate t1/t3 approximates 1, the fluctuation of the electric current value per unit time is decreased so that the generation of electric noises can be decreased. However, to jet flame-shaped plasma having a size sufficiently large for ignition of air-fuel mixture, it is necessary to supply a large amount of energy to the spark discharge gap within a short time. To discharge a larger amount of energy stored in the capacitor 132 within a short time, according to an example 5 described below, it is found that the rate t1/t3 is preferably set to not more than ⅗.

In this manner, to suppress the generation of electric noises while allowing an electric current having a size sufficiently large for forming plasma to the spark discharge gap, the above-mentioned conditions are prescribed with respect to the supply state of energy to the spark discharge gap at the time of spark discharge in the ignition device 200. The following various evaluation tests are carried out for confirming whether or not advantageous effects acquired by the prescription of such conditions are obtained.

EXAMPLE 1

First, an evaluation test is carried out for confirming advantageous effects acquired by providing the resistance R1 of not less than 1KΩ and not more than 20KΩ between the spark discharge circuit 110 and the plasma jet ignition plug 100 and also by setting the inner resistance R2 of the line B-A, which connects the plasma discharge circuit 130 and the plasma jet ignition plug 100, to not more than 1Ω. In this evaluation test, the ground electrode made of Ir-5pt, having a thickness of 1.0 mm and having an inner diameter of the communication hole set to ϕ1.0 mm is prepared. The ground electrode is mounted on the main body fitting, thus completing the plasma jet ignition plug for testing in which an inner diameter of the cavity is set to ϕ0.8 mm, and a depth (a length in the axis O direction) of the cavity is set to 1.5 mm. The plasma jet ignition plug is connected to an ignition device for testing. Then, a plurality of resistances that differ in an electric resistance value within a range of 0 to 30KΩ is prepared and these resistances are assembled into the ignition device as the resistance R1. Further, a plurality of resistances differ in an electric resistance value within a range of 0 to 1.5KΩ is separately prepared, and these resistances are assembled into the line B-A, thus simulating the inner resistance R2 of the line B-A. Here, the evaluation test when the electric resistance value of the resistance R1 and the electric resistance value of the inner resistance R2 are set to 0Ω is carried out by short-circuiting the line B-A without assembling the resistance R1 and the inner resistance R2 in an actual evaluation test.

Using the ignition device for testing which is prepared in this manner and by suitably combining the resistance R1 and the inner resistance R2, a desk-on ignition test is carried out in which spark discharge is performed by the above-mentioned plasma jet ignition plug for testing at an atmospheric pressure. An amount of energy which is supplied for allowing the ignition device to perform jetting of plasma one time (a sum of an amount of energy supplied from a capacitor for trigger discharge and an amount of energy supplied from a capacitor for plasma discharge) is set to 150 mJ. Then, among various standards prescribed by International Special Committee on Radio Interference (CISPR), in accordance with a measuring method which is described in "allowable values and a measuring method of disturbance waves from a vehicle, a motorboat and a spark-ignition-engine driven device" which is identified as CISPR12, a level of disturbance waves (electric noises) generated from the plasma jet ignition plug is measured. Further, plasma jetted from the plasma jet ignition plug is photographed for every one-time discharge with a shutter in an opened state.

In measuring the level of the electric noises, it is assumed that when the level of the disturbance waves under the above-mentioned standards satisfies an allowable value (reference value) (being not more than the allowable value), it is possible to acquire an advantageous effect of decreasing electric noises generated by the plasma jet ignition plug 100 using the ignition device 200 of this example. Particularly, when the measured level of disturbance waves is smaller than the allowable value by not less than 10 dB, a large electric-noises reduction effect is obtained so that the evaluation "Excellent" is given. Even when the measured level of the disturbance waves is decreased by less than 10 dB from the allowable value, a sufficient electric-noises reduction effect is obtained so that the evaluation "Good" is given. When the measured level of the disturbance waves does not satisfy the allowable value (when the measured level of the disturbance waves is larger than the allowable value), it is evaluated that the advantageous effect which decreases electric noises generated by the plasma jet ignition plug 100 using the ignition device 200 cannot be obtained so that the evaluation "Bad" is given. A result of this evaluation test is shown in Table 1.

TABLE 1

| | | R2[Ω] | | | | | | | |
|---|---|---|---|---|---|---|---|---|---|
| | | 0 | 0.1 | 0.2 | 0.5 | 0.7 | 1 | 1.2 | 1.5 |
| R1[KΩ] | 0 | Bad | Bad | Bad | Bad | Bad | Bad | Bad | Bad |
| | 0.1 | Bad | Bad | Bad | Bad | Bad | Good | Good | Good |
| | 0.5 | Bad | Bad | Bad | Good | Good | Good | Good | Good |
| | 1 | Good | Good | Good | Good | Good | Good | Good | Good |
| | 3 | Good | Good | Good | Good | Good | Good | Good | Good |
| | 5 | Good | Good | Good | Good | Good | Good | Good | Good |
| | 10 | Good | Good | Good | Good | Good | Good | Good | Excellent |
| | 15 | Good | Good | Good | Good | Good | Good | Excellent | Excellent |
| | 20 | Good | Good | Good | Good | Excellent | Excellent | Excellent | Excellent |
| | 25 | Good | Excellent | Excellent | Excellent | Excellent | Excellent | Excellent | Excellent |
| | 30 | Excellent | Excellent | Excellent | Excellent | Excellent | Excellent | Excellent | Excellent |

With respect to a jetting state of plasma, it is determined that a sufficiently large amount of plasma is jetted when a jetting length of plasma jetted from the plasma jet ignition plug reaches 1 mm or more using a leading end surface of the ground electrode as the reference. Then, when a sufficiently large amount of plasma can be jetted nine times or more with respect to discharge performed ten times, it is determined that plasma is favorably jetted by the plasma jet ignition plug 100 using the ignition device 200, and the evaluation "Good" is given. When jetting of normal plasma is not performed two times or more in performing the discharge ten times, it is determined that the jetting of plasma is insufficient and the evaluation "Bad" is given. A result of this evaluation test is shown in Table 2.

TABLE 2

| | | R2[Ω] | | | | | | | |
|---|---|---|---|---|---|---|---|---|---|
| | | 0 | 0.1 | 0.2 | 0.5 | 0.7 | 1 | 1.2 | 1.5 |
| R1[KΩ] | 0 | Good | Good | Good | Good | Good | Good | Bad | Bad |
| | 0.1 | Good | Good | Good | Good | Good | Good | Bad | Bad |
| | 0.5 | Good | Good | Good | Good | Good | Good | Bad | Bad |
| | 1 | Good | Good | Good | Good | Good | Good | Bad | Bad |
| | 3 | Good | Good | Good | Good | Good | Good | Bad | Bad |
| | 5 | Good | Good | Good | Good | Good | Good | Bad | Bad |
| | 10 | Good | Good | Good | Good | Good | Good | Bad | Bad |
| | 15 | Good | Good | Good | Good | Good | Good | Bad | Bad |
| | 20 | Good | Good | Good | Good | Good | Good | Bad | Bad |
| | 25 | Bad | Bad | Bad | Bad | Bad | Bad | Bad | Bad |
| | 30 | Bad | Bad | Bad | Bad | Bad | Bad | Bad | Bad |

As shown in Table 1, on a condition that the inner resistance R2 is fixed to 0Ω and the electric resistance value of the resistance R1 is varied, when the resistance R1 assumes less than 1KΩ, the level of electric noises generated at the time of trigger discharge is large so that the allowable value set by the CISPR12 is not satisfied. Further, when the electric resistance value of the inner resistance R2 is increased, it is found that even when the electric resistance value of the resistance R1 is lowered to a value below 1KΩ, the level of the electric noises satisfies the allowable value. To be more specific, by setting the inner resistance R2 to not less than 0.5Ω, it is found that the electric noises can be decreased to the allowable value when the resistance R1 is set to not less than 0.5KΩ. Further, by setting the inner resistance R2 to not less than 1Ω, it is found that even when the resistance R1 is decreased to 0.1KΩ, the electric noises can be sufficiently decreased to the allowable value. From these findings, it is understood that irrespective of an amount of the electric resistance value of the inner resistance R2, by setting the resistance R1 to not less than 1KΩ, it is possible to decrease the electric noises to the allowable value.

However, as shown in Table 2, when the inner resistance R2 is increased more than 1Ω, a loss of energy at the time of plasma discharge is large so that sufficiently large plasma is not formed. This implies that the formation of plasma does not depend on the electric resistance value of the resistance R1 from Table 2. Accordingly, it is desirable to set the inner resistance R2 to not more than 1Ω. Further, it is understood from Table 2 that irrespective of an amount of the electric resistance value of the inner resistance R2, when the resistance R1 is more than 20KΩ, a discharge voltage at the time of trigger discharge is lowered so that the spark discharge is not performed whereby plasma is not jetted.

As a result of this evaluation test, it is confirmed that by providing the resistance R1 having the electric resistance value of not less than 1KΩ and not more than 20KΩ to the ignition device 200, and by setting the electric resistance value of the inner resistance R2 to not more than 1Ω, the generation of electric noises can be suppressed while allowing an electric current sufficiently large for forming plasma to flow into the spark discharge gap.

EXAMPLE 2

Figure 5:
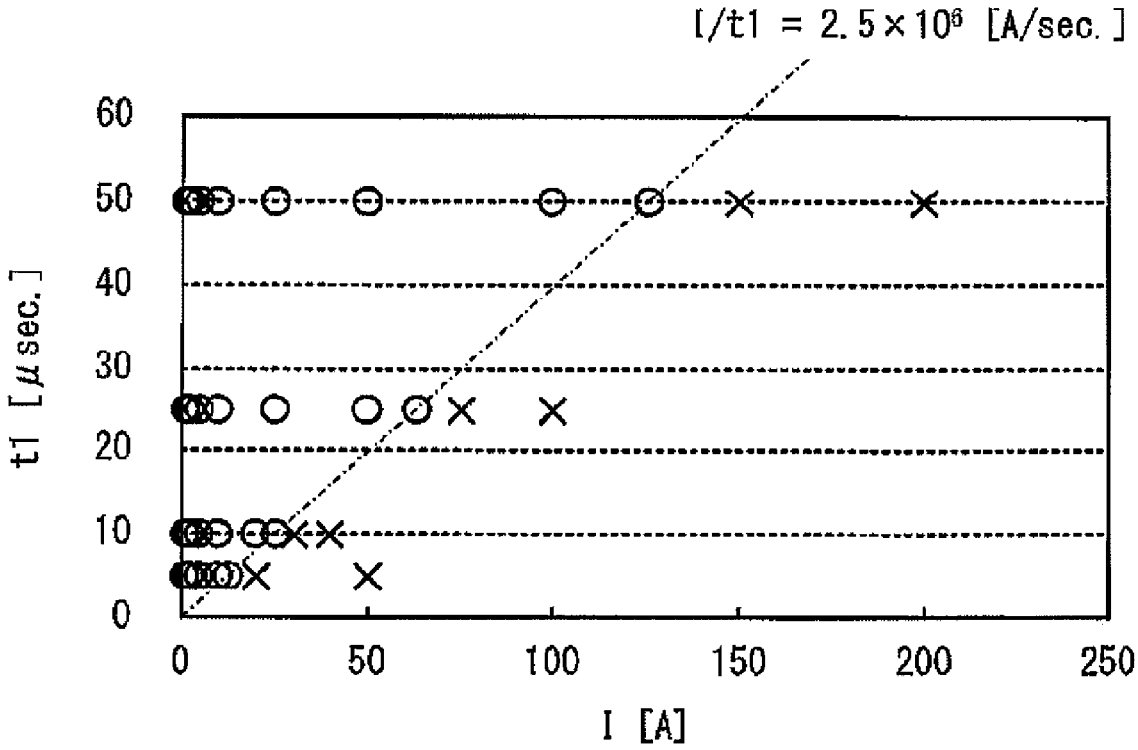
FIG. 5 is a graph showing the relationship between a maximum value I of an electric current which flows into the spark discharge gap at the time of plasma discharge, and time period t1 which elapses until the electric current assumes the maximum value I, wherein the relationship between I and t1 is used in determination of whether the plasma jet ignition plug is good or bad based on a level of electric noises.

Next, an evaluation test is carried out for confirming the relationship between the maximum value I of an electric current which flows into the spark discharge gap at the time of plasma discharge and time period t1 which elapses until the electric current assumes the maximum value I. In this evaluation test, a plasma jet ignition plug for testing similar to the plasma jet ignition plug used in example 1 is prepared. The plasma jet ignition plug is connected to an ignition device for testing in which a resistance R1 is set to 20KΩ and an inner resistance R2 is set to 1Ω. Then, a desk-on ignition test similar to the desk-on ignition test explained in conjunction with the example 1 is carried out. As inductors and capacitors used in a plasma discharge circuit of the ignition device, various inductors which differ in inductance and various capacitors which differ in electrostatic capacitance are prepared. A plasma discharge is performed by suitably combining these inductors and capacitors. In performing such a plasma discharge, an electric current which flows into a point A is measured so as to obtain the maximum value I and the time period t1. Further, with respect to each combination, a value of I/t1 which indicates the fluctuation of an amount of the electric current per unit time, which is obtained by dividing the maximum value I of the electric current which flows into the spark discharge gap by the time period t1 which elapses until the electric current assumes the maximum value I. Then, in the same manner as example 1, the measurement of a level of electric noises generated from the plasma jet ignition plug and the determination of a jetting state of plasma are carried out. With respect to the measurement of the level of the electric noises, whether the plasma jet ignition plug is good or bad is determined based on whether or not the level of the electric noises is lower than an allowable value set by CISPR12, as explained in conjunction with the example 1, by 10 dB. A result of this evaluation test is shown in Table 3 and FIG. 5 and FIG. 6.

TABLE 3

| maximum value of electric current I[A] | time until electric current assumes maximum value I t1 [μsec] | I/t1 [$\times 10^6$ A/sec] | level of electric noises | jetting state of plasma |
|---|---|---|---|---|
| 1 | 50 | 0.02 | Good | Bad |
| 2.5 | | 0.05 | Good | Bad |
| 5 | | 0.1 | Good | Good |
| 10 | | 0.2 | Good | Good |
| 25 | | 0.5 | Good | Good |
| 50 | | 1.0 | Good | Good |
| 100 | | 2.0 | Good | Good |
| 125 | | 2.5 | Good | Good |
| 150 | | 3.0 | Bad | Good |
| 200 | | 4.0 | Bad | Good |
| 1 | 25 | 0.04 | Good | Bad |
| 2.5 | | 0.1 | Good | Bad |
| 5 | | 0.2 | Good | Good |
| 10 | | 0.4 | Good | Good |
| 25 | | 1.0 | Good | Good |
| 50 | | 2.0 | Good | Good |
| 62.5 | | 2.5 | Good | Good |
| 75 | | 3.0 | Bad | Good |
| 100 | | 4.0 | Bad | Good |
| 1 | 10 | 0.1 | Good | Bad |
| 2.5 | | 0.25 | Good | Bad |
| 5 | | 0.5 | Good | Good |
| 10 | | 1.0 | Good | Good |
| 20 | | 2.0 | Good | Good |
| 25 | | 2.5 | Good | Good |
| 30 | | 3.0 | Bad | Good |
| 40 | | 4.0 | Bad | Good |
| 1 | 5 | 0.2 | Good | Bad |
| 2.5 | | 0.5 | Good | Bad |
| 5 | | 1.0 | Good | Good |
| 10 | | 2.0 | Good | Good |
| 12.5 | | 2.5 | Good | Good |
| 20 | | 4.0 | Bad | Good |
| 50 | | 10.0 | Bad | Good |

As shown in Table 3, when the value of I/t1 is not less than $3.0\times10^6$ A/sec, the level of electric noises generated by the plasma discharge is elevated so that a value lower than the allowable value set by CISPR12 by 10 dB is not satisfied. On the other hand, when the value of I/t1 is not more than $2.5\times10^6$ A/sec, the generation of electric noises can be sufficiently suppressed. It is found from this result that the relationship between the maximum value I and the time period t1 can be more clearly confirmed by expressing the relationship in a graph shown in FIG. 5, wherein the generation of electric noises can be suppressed by suppressing the fluctuation of an amount of electric current per unit time by setting the value of I/t1 to not more than $2.5\times10^6$ A/sec.

Figure 6:
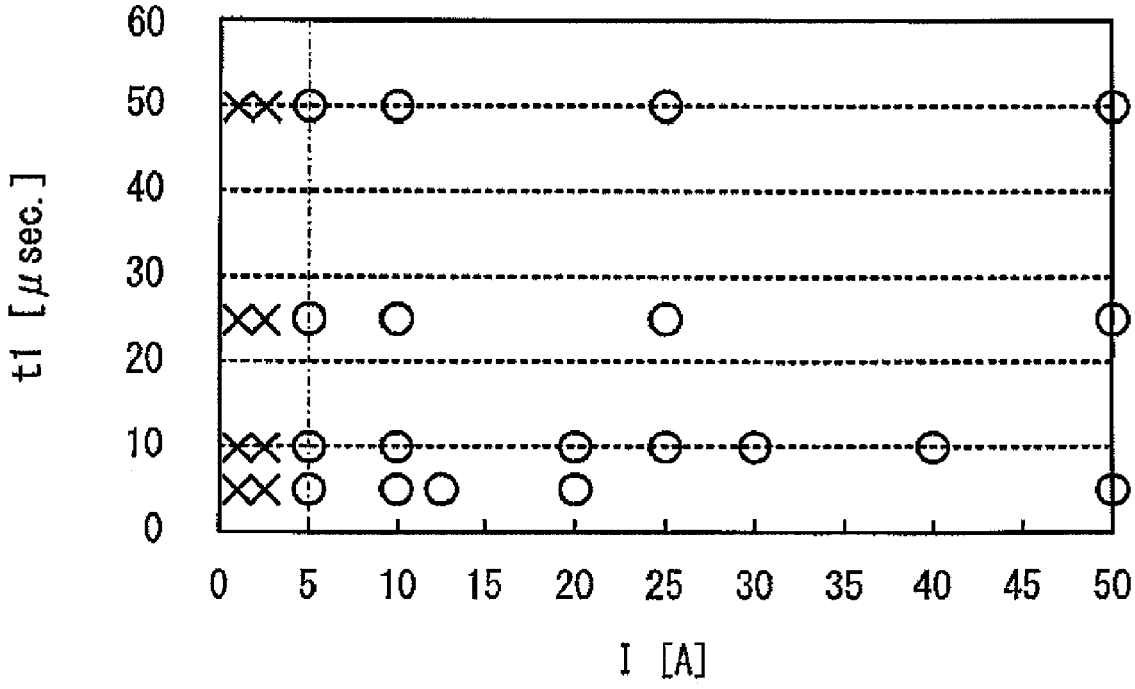
FIG. 6 is a graph showing the relationship between a maximum value I of an electric current which flows into the spark discharge gap at the time of plasma discharge, and time period t1 which elapses until the electric current assumes the maximum value I, wherein the relationship between I and t1 is used in determination of whether the plasma jet ignition plug is good or bad based on a jetting state of plasma.

Further, to focus on the maximum value I of the electric current, as shown in Table 3 and FIG. 6, when the maximum value I is less than 5 A, energy supplied to the spark discharge gap is decreased so that a sufficiently large size of plasma cannot be formed. From this result, it is confirmed that by selecting the capacitor having electrostatic capacitance capable of setting the maximum value I of the electric current which flows into the spark discharge gap to not less than 5 A and, at the same time, by using the inductor having the inductance capable of setting the value of I/t1 to not more than $2.5\times10^6$ A/sec it is possible to suppress the generation of electric noises while allowing an electric current sufficiently large for forming the plasma to flow into the spark discharge gap.

EXAMPLE 3

Next, an evaluation test is carried out for confirming time period t1 which elapses until an electric current which flows into a spark discharge gap at the time of plasma discharge assumes a maximum value I. In this evaluation test, a plasma jet ignition plug for testing similar to the plasma jet ignition plug explained in conjunction with example 1 is prepared. The plasma jet ignition plug is connected to an ignition device for testing in which a resistance R1 is set to 20KΩ and an inner resistance R2 is set to 1Ω. Here, an amount of energy which is supplied for allowing the ignition device to perform jetting of plasma one time (a sum of an amount of energy supplied from a capacitor for a trigger discharge and an amount of energy supplied from a capacitor for a plasma discharge) is set to 150 mJ. Further, as an inductor used in a plasma discharge circuit, various inductors which differ in inductance are prepared. The plasma jet ignition plug for testing is mounted in a chamber while suitably exchanging the inductors, and the ignition property of the plasma jet ignition plug is confirmed. To be more specific, the plasma jet ignition plug is mounted in the chamber and, thereafter, the inside of the chamber is filled with an air-fuel mixture in which a mixing ratio (air/furl ratio) of air and a $C_3H_8$ gas is set to 20, and a gas pressure is set to 0.05 MPa (gas filling step). The trigger discharge and the plasma discharge are performed in the plasma jet ignition plug by the ignition device so as to try the ignition of the air-fuel mixture (voltage applying step). A pressure change in the inside of the chamber is measured by a pressure sensor so as to confirm whether or not the air-fuel mixture is ignited (ignition confirming step). A series of steps is tried 100 times and the ignition probability is calculated. Further, an electric current which flows into the point A at the time of plasma discharge is measured, and time period t1 which elapses until the electric current assumes the maximum value I is obtained. A result of the test is shown in a graph in FIG. 7.

Figure 7:
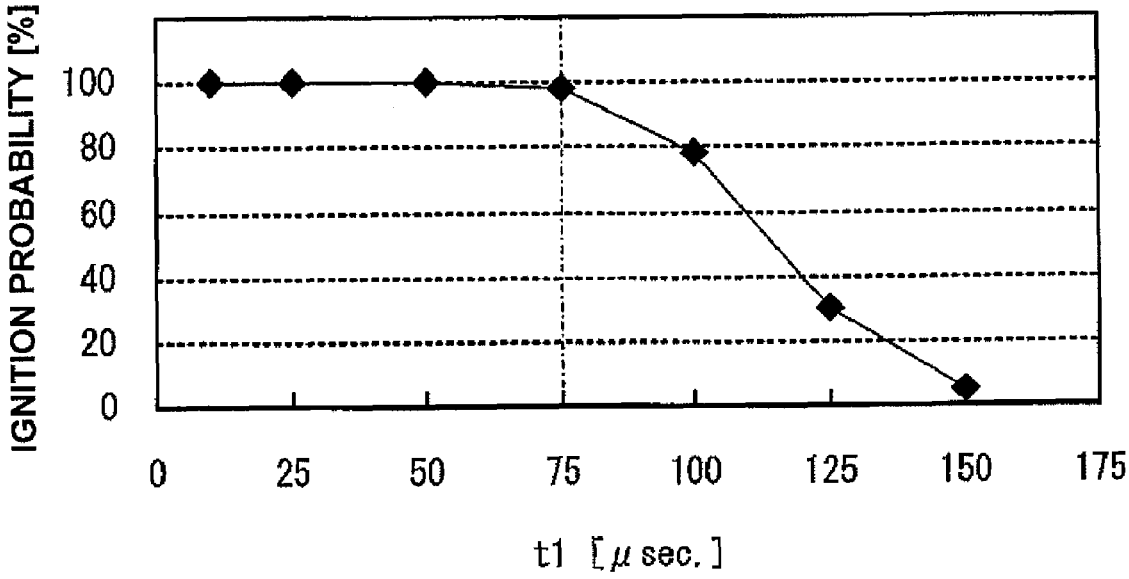
FIG. 7 is a graph showing the relationship between time period t1 which elapses until an electric current, which flows into a spark discharge gap at the time of plasma discharge assumes a maximum value I, and the ignition probability.

As shown in FIG. 7, when the time period t1, which elapses until the electric current that flows into the spark discharge gap assumes the maximum value I after the plasma discharge is started, is within 50 μsec, the ignition probability of 100% is obtained. Even when the time period t1 is 75 μsec, the ignition probability of 98% is obtained. However, when the time period t1 becomes 100 μsec, the ignition probability is lowered to 78%. When the time period t1 exceeds 100 μsec, the ignition probability is further lowered. From such a result of the test, it is confirmed that the sufficient ignition property is acquired by selecting the inductor used in the plasma discharge circuit such that the electric current which flows into the spark discharge gap assumes the maximum value I within 75 μsec from starting of plasma discharge.

EXAMPLE 4

Next, an evaluation test is carried out for confirming time period t2 which elapses until an electric current, which flows into a spark discharge gap by a plasma discharge, assumes a maximum value I from the generation of dielectric breakdown in the spark discharge gap by a trigger discharge. In this evaluation test, a plasma jet ignition plug for testing similar to the plasma jet ignition plug explained in conjunction with example 1 is prepared, and the plasma jet ignition plug is connected to an ignition device for testing in which a resistance R1 is set to 20KΩ and an inner resistance 12 is set to 1Ω. A switch is provided to a path which supplies energy to the plasma jet ignition plug from a plasma discharge circuit, to be more specific, to a line B-A. Due to such a switch, time from a point of time that the dielectric breakdown is generated in the spark discharge gap to a point of time that the plasma discharge is started can be properly adjusted. Further, a capacitor used in the plasma discharge circuit is selected such that a maximum value I of an electric current, which flows into the point A after a lapse of 60 μsec from the starting of plasma discharge, becomes 50 A. An amount of energy which the ignition device supplies for performing jetting of plasma one time becomes 150 mJ.

Then, the plasma jet ignition plug for testing is mounted in a chamber. While suitably adjusting time from a point of time that the dielectric breakdown is generated in the spark discharge gap to a point of time that the plasma discharge is started, in the same manner as the example 3, an ignition test of the plasma jet ignition plug is carried out, and the ignition probability is obtained. Here, the inside of the chamber is filled with an air-fuel mixture in which a mixing ratio (air fuel ratio) of air and a $C_3H_8$ gas is set to 22. Further, an electric current which flows into the point A is measured, and a time period t2, which elapses from a point of time that dielectric breakdown is generated in the spark discharge gap by trigger discharge to a point of time that the electric current which flows into the spark discharge gap assumes a maximum value I, is obtained. A result of the test is shown in a graph in FIG. 8.

Figure 8:
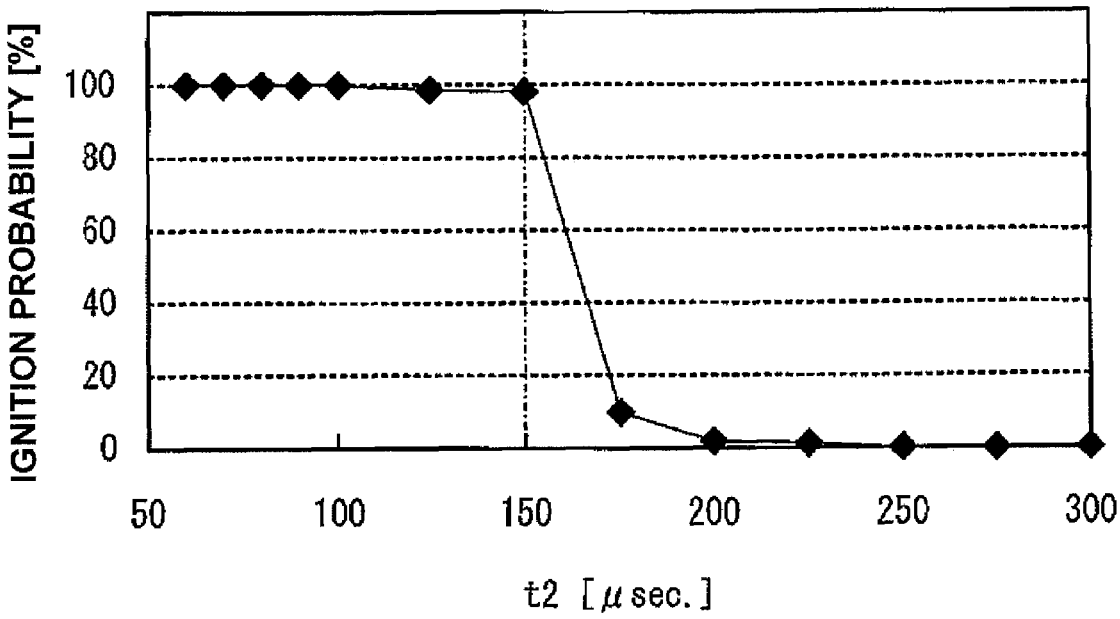
FIG. 8 is a graph showing the relationship between time period t2, which elapses until an electric current which flows into the spark discharge gap by plasma discharge assumes a maximum value I from the generation of dielectric breakdown in the spark discharge gap by trigger discharge, and the ignition probability.

As shown in FIG. 8, when the time period t2, which elapses until an electric current which flows into the spark discharge gap assumes the maximum value I from a point of time that dielectric breakdown is generated in the spark discharge gap by the trigger discharge, is within 100 μsec, the ignition probability of 100% is obtained. Even when the time period t2 is within 150 μsec, the ignition probability of 98% or more is obtained. However, when the time period t2 becomes 175 μsec, the ignition probability is rapidly lowered to 10%. When the time period t2 exceeds 175 μsec, the ignition probability is further lowered. From such a result of the test, it is confirmed that the sufficient ignition property is acquired by selecting the inductor used in the plasma discharge circuit such that the electric current, which flows into the spark discharge gap, assumes the maximum value I within 150 μsec from a point of time that dielectric breakdown is generated in the spark discharge gap by the trigger discharge.

EXAMPLE 5

An evaluation test is carried out for confirming a rate t1/t3 between time period t1 which elapses until an electric current, which flows into the spark discharge gap, assumes a maximum value I and time period t3 which elapses from a point of time that plasma discharge is started to a point of time that the supply of energy is finished. In this evaluation test, a plasma jet ignition plug for testing similar to the plasma jet ignition plug explained in conjunction with the example 1 is prepared. The plasma jet ignition plug is connected to an ignition device for testing in which a resistance R1 is set to 20KΩ and an inner resistance R2 is set to 1Ω. In the same manner as example 4, a switch is provided to a path (on a line B-A) which supplies energy to the plasma jet ignition plug from a plasma discharge circuit. Due to such a switch, a time period, which elapses from a point of time that the dielectric breakdown is generated in the spark discharge gap to a point of time that the plasma discharge is started, is delayed by 60 μsec. Further, a capacitor used in the plasma discharge circuit is selected such that a maximum value I of an electric current, which flows into a point A after a lapse of 60 μsec from a start of plasma discharge, becomes 50 A. An amount of energy which the ignition device supplies for performing jetting of plasma one time becomes 150 mJ. Further, as an inductor used in a plasma discharge circuit, various inductors which differ in inductance are prepared.

Then, the plasma jet ignition plug for testing is mounted in a chamber, and various inductors which differ in inductance are suitably assembled in the plasma discharge circuit in an exchanging manner. In the same manner as example 3, an ignition test of the plasma jet ignition plug is carried out so as to obtain the ignition probability. Here, the inside of the chamber is filled with an air-fuel mixture in which a mixing ratio (air fuel ratio) of air and a $C_3H_8$ gas is set to 24. Further, an electric current which flows into a point A is measured, and time period t1 which elapses from a point of time that plasma discharge is started to a point of time that the electric current which flows into the spark discharge gap assumes a maximum value I, and time period t3 which elapses from a point of time that plasma discharge is started to a point of time that the supply of energy is finished, are obtained, and a rate t1/t3 is calculated. A result of the test is shown in a graph in FIG. 9.

Figure 9:
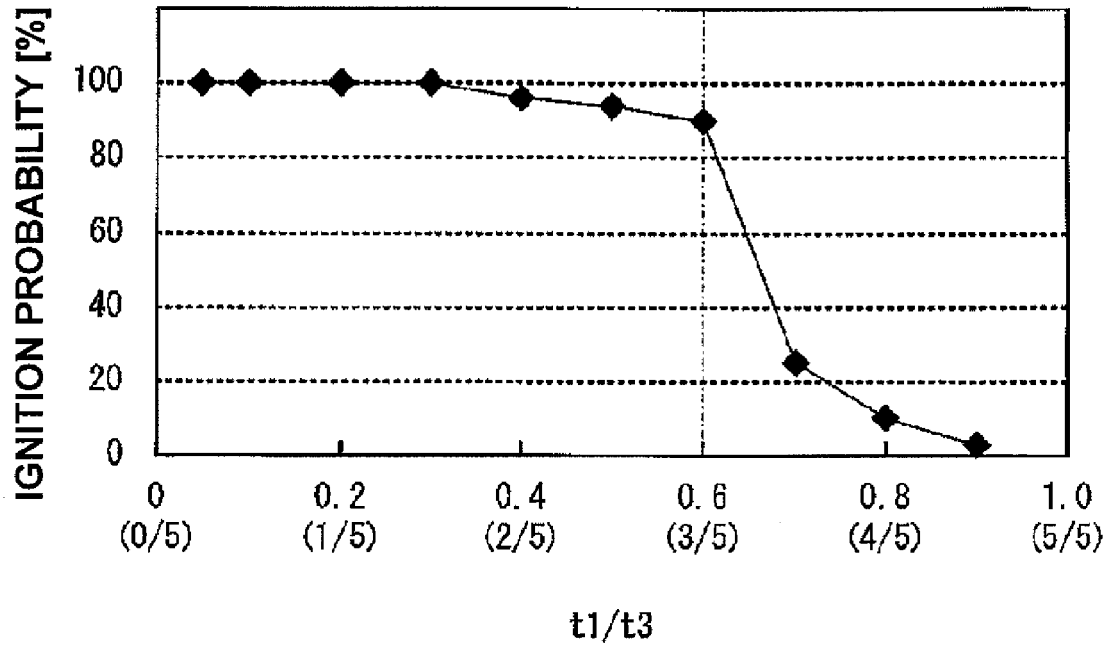
FIG. 9 is a graph showing the relationship between a rate t1/t3 between time period t1 which elapses until an electric current which flows into the spark discharge gap assumes a maximum value I, and time period t3 which elapses from a point of time that plasma discharge is started to a point of time that the supply of energy is finished, and the ignition probability.

As shown in FIG. 9, when the rate t1/t3 is not more than 0.3(3/10), the ignition probability of 100% is obtained. Even when the rate t1/t3 is not more than 0.6(3/5), the ignition probability of 90% or more is obtained. However, when the rate t1/t3 becomes 0.7 (7/10), the ignition probability is rapidly lowered to 25%. When the rate t1/t3 exceeds 0.7 (7/10), the ignition probability is further lowered. From such a result of the test, it is confirmed that the sufficient ignition property is acquired by selecting the inductor used in the plasma discharge circuit such that the rate t1/t3 between time period ti, which elapses until an electric current which flows into the spark discharge gap assumes a maximum value I, and time period t3, which elapses from a point of time that plasma discharge is started to a point of time that the supply of energy is finished, becomes not more than 3/5.

Various modifications are conceivable with respect to the present invention. For example, the present invention has been explained by taking the CDI-type power source as the ignition device 200. However, the ignition device 200 may be of any other ignition type such as a full transistor type or a point (contact) type. Further, although the present invention adopts a mode in which the electric current flows toward a ground electrode 30 side from a center electrode 20 side, the present invention may adopt a power source or the circuit constitution in which polarities are exchanged so that an electric current flows from the ground electrode 30 side to the center electrode 20 side. Further, the present invention has been explained by taking, as an example, the ignition device 200 which outputs energy of 150 mJ (that is, the ignition device which adjusts a sum of an amount of energy stored in a capacitor 114 for trigger discharge in a spark discharge gap and an amount of energy stored in a capacitor 132 for plasma discharge in the spark discharge gap to 150 mJ), the present invention is not limited to such an ignition device 200.

Further, in the embodiment, the inductor 133 is provided to the path which supplies energy to the spark discharge gap at the time of plasma discharge, thus suppressing the rapid fluctuation of an amount of electric current whereby energy can be continuously supplied to the spark discharge gap. The present invention is not limited to the use of the inductor 133. For example, the present invention also can perform a PWM control so as to suppress the instantaneous discharge of energy stored in the capacitor 132 at the time of plasma discharge, thus enabling the continuous supply of energy to the spark discharge gap.

As described above, an ignition device for a plasma jet ignition plug according to a first aspect of the embodiment is an ignition device for a plasma jet ignition plug for applying a voltage to a plasma jet ignition plug in which a cavity is formed surrounding a periphery of at least a portion of a spark discharge gap formed between a center electrode and a ground electrode so as to form a discharge space. Plasma formed in the cavity is jetted from an opening formed in the cavity along with spark discharge generated in the spark discharge gap. The ignition device includes: a discharge voltage applying unit which applies a voltage for generating the spark discharge caused by dielectric breakdown in the spark discharge gap to the plasma jet ignition plug, and an energy supplying unit which supplies energy to the spark discharge gap for forming the plasma along with the spark discharge generated by the application of the voltage using the discharge voltage applying unit. A resistor is arranged between the plasma jet ignition plug and the discharge voltage applying unit so as to set an electric resistance value between the plasma jet ignition plug and the discharge voltage applying unit to not less than 1KΩ and not more than 20KΩ, and an electric resistance value between the plasma jet ignition plug and the energy supply unit is set to not more than 1Ω.

An ignition device for a plasma jet ignition plug according to a second aspect of the embodiment is characterized in that, in addition to the constitution of the first aspect, in jetting the plasma from the plasma jet ignition plug one time, using a time at which the supply of energy to the spark discharge gap from the energy supply unit is started as a start point, and assuming a time period, which elapses until a value of an electric current which flows into the spark discharge gap along with the supply of the energy assumes a maximum value I [A] from the start point, as t1 [sec], the following formulae (1) and (2) are satisfied.

$$I/t1 \leqq 2.5\times10^{6}\ [A/\text{sec}] \quad (1)$$

$$I \geqq 5\ [\text{A}] \quad (2)$$

An ignition device for a plasma jet ignition plug according to a third aspect of the embodiment is characterized in that, in addition to the constitution described in the first aspect or the second aspect, in jetting the plasma from the plasma jet ignition plug one time, using a time at which the supply of energy to the spark discharge gap from the energy supply unit is started as a start point and assuming a time period, which elapses until a value of an electric current which flows into the spark discharge gap along with the supply of the energy assumes a maximum value I [A] from the start point, as t1 [sec], the following formula (3) is satisfied.

$$t1 \leqq 75\ [\mu\text{sec}] \quad (3)$$

An ignition device for a plasma jet ignition plug according to a fourth aspect of the embodiment is characterized in that, in addition to the constitution described in any one of the first aspect to third aspect, in jetting the plasma from the plasma jet ignition plug one time, using a time at which the spark discharge is generated due to dielectric breakdown in the spark discharge gap caused by the application of voltage using the discharge voltage applying unit as a start point, and assuming a time period, which elapses until a value of an electric current which flows into the spark discharge gap along with the supply of the energy from the energy supply unit assumes a maximum value I [A] from the start point, as t2 [sec], the following formula (4) is satisfied.

$$t2 \leqq 150\ [\mu\text{sec}] \quad (4)$$

An ignition device for a plasma jet ignition plug according to a fifth aspect of the embodiment is characterized in that, in addition to the constitution described in any one of the first aspect to the fourth aspect, in jetting the plasma from the plasma jet ignition plug one time, using a time at which the supply of energy to the spark discharge gap from the energy supply unit is started as a start point; and assuming a time period, which elapses until a value of an electric current which flows into the spark discharge gap assumes a maximum value I [A] along with the supply of the energy from the start point, as t1 [sec]; and assuming a time period which elapses until the supply of energy from the energy supply unit is finished, as t3 [sec], the following formula (5) is satisfied.

$$t1/t3 \leqq 3/5 \quad (5)$$

According to the ignition device for the plasma jet ignition plug of the first aspect, at the time of ignition, a large voltage is instantaneously applied to the spark discharge gap from the discharge voltage applying unit, thus generating dielectric breakdown in the spark discharge gap. Although a large amount of electric current flows into the spark discharge gap rapidly at the time of dielectric breakdown, the resistor having an electric resistance value of not less than 1KΩ and not more than 20KΩ is arranged between the discharge voltage applying unit and the spark discharge gap. Therefore, it is possible to suppress the generation of electric noises at the time of dielectric breakdown.

After the dielectric breakdown, energy for forming plasma is supplied from the energy supply unit so as to allow an electric current to flow into the spark discharge gap. Although it is necessary to allow a large amount of electric current to flow into the spark discharge gap for forming plasma, the electric resistance value between the energy supply unit and the spark discharge gap is set to not more than 1Ω. Accordingly, a loss of energy for forming plasma between the energy supply unit and the spark discharge gap is small. Hence, an amount of electric current which flows into the spark discharge gap is hardly suppressed, thus enabling the jetting of flame-shaped plasma having energy sufficient for ignition of an air-fuel mixture.

The larger the fluctuation of a flow rate per unit time of an electric current which flows when energy is supplied to the spark discharge gap from the energy supply unit, the larger the generation of the electric noises becomes. Accordingly, in the second aspect of the embodiment, there is provided the relationship formula (1) indicating the relationship between the maximum value I of the electric current which flows into the spark discharge gap and time period t1 until the electric current assumes the maximum value I from the start of the electric current flow. That is, the relationship formula (1) prescribes that I/t1 is set to not more than $2.5\times10^{6}$. Due to such setting of the relationship formula (1), the fluctuation of the flow rate of the electric current per unit time can be suppressed, thus suppressing the generation of electric noises.

By imposing the limitation on I/t1, when the maximum value I of the electric current which flows into the spark discharge gap is decreased, there is a possibility that plasma sufficiently large for ignition cannot be formed. Accordingly, in the second aspect of the embodiment, the relationship formula (2) is prescribed such that the maximum value I is set to not less than 5 A. Due to such setting of the relationship formula (2), an electric current sufficiently large for forming plasma can flow into the spark discharge gap. Hence, it is possible to form plasma having sufficiently large energy and to jet such plasma while suppressing the generation of electric noises.

Further, in the third aspect of the embodiment, as indicated by the relationship formula (3), t1 is set to not more than 75 μsec, thus prescribing a time period which elapses until the electric current flowing in the spark discharge gap along with energy supplied to the spark discharge gap for forming plasma assumes the maximum value I after the supply of the electric current. Although the formed plasma is jetted in a flame-shape from the opening of the cavity, when t1 exceeds 75 μsec, an amount of energy supplied to the spark discharge gap per unit time is decreased (in other words, time-wise density of energy is decreased). Hence, the formed plasma cannot possess sufficient energy whereby a jetting length of plasma becomes short, thus giving rise to a possibility that ignition property is lowered.

Further, in the fourth aspect of the embodiment, as indicated by the relationship formula (4), t2 is set to not more than 150 μsec, thus prescribing a time period which elapses until the electric current flowing in the spark discharge gap along with energy supplied to the spark discharge gap for forming plasma assumes the maximum value I after dielectric breakdown. An insulation resistance value in the spark discharge gap assumes a minimum value immediately after the generation of the dielectric breakdown and is gradually increased thereafter. Accordingly, if energy for forming plasma is supplied at a relatively early stage after dielectric breakdown and the electric current assumes the maximum value I, a loss of energy can be further decreased, thus enabling the jetting of flame-shaped plasma sufficiently large for the ignition of an air-fuel mixture. When t2 exceeds 150 μsec, there exists a possibility that plasma sufficiently large for ignition cannot be formed.

Further, in the fifth aspect of the embodiment, as indicated by the relationship formula (5), the relationship between t3 corresponding to a supply time of energy to be supplied for forming plasma and time period t1 for allowing the current value to assume the maximum value I after starting the supply of energy is prescribed. That is, it is prescribed that t1/t3 becomes not more than ⅗. The closer t1/t3 approximates to 1, the smaller the fluctuation of the electric current per unit time becomes, thus decreasing the generation of electric noises. However, an amount of energy supplied per unit time is decreased. Accordingly, the formed plasma cannot possess sufficient energy, thus giving rise to a possibility that plasma sufficiently large for ignition cannot be formed. To jet flame-shaped plasma sufficiently large for ignition of an air-fuel mixture, it is necessary to supply a larger amount of energy to the spark discharge gap within a short time. To this end, t1/t3 may be set to not more than ⅗.

Having described the invention, the following is claimed:

1. An ignition device for a plasma jet ignition plug which is configured to apply a voltage to the plasma jet ignition plug in which a cavity is formed surrounding a periphery of at least a portion of a spark discharge gap formed between a center electrode and a ground electrode so as to form a discharge space, and plasma formed in the cavity is jetted from an opening formed in the cavity along with spark discharge generated in the spark discharge gap, the ignition device comprising:

a discharge voltage applying unit to apply a voltage for generating the spark discharge caused by dielectric breakdown in the spark discharge gap to the plasma jet ignition plug; and an energy supplying unit to supply energy to the spark discharge gap for forming the plasma along with the spark discharge, wherein a resistor (R1) is arranged between the plasma jet ignition plug and the discharge voltage applying unit to set an electric resistance value between the plasma jet ignition plug and the discharge voltage applying unit to not less than 1KΩ and not more than 20KΩ, and an electric resistance value between the plasma jet ignition plug and the energy supply unit is set to not more than 1Ω.

2. The ignition device according to claim 1, wherein in jetting the plasma from the plasma jet ignition plug one time, using time (Tc) at which the supply of energy to the spark discharge gap from the energy supply unit is started as a start point and assuming a time period, which elapses until a value of an electric current which flows into the spark discharge gap along with the supply of the energy assumes a maximum value I [A] from the start point, as t1 [sec], following formulae (1) and (2) are satisfied:

$$I/t1 \leqq 2.5\times10^6\ [A/\text{sec}] \quad (1)$$

$$I \geqq 5\ [A] \quad (2).$$

3. The ignition device according to claim 1, wherein in jetting the plasma from the plasma jet ignition plug one time, using time (Tc) at which the supply of energy to the spark discharge gap from the energy supply unit is started as a start point and assuming a time period, which elapses until a value of an electric current which flows into the spark discharge gap along with the supply of the energy assumes a maximum value I [A] from the start point, as t1 [sec], a following formula (3) is satisfied:

$$t1 \leqq 75\ [\mu\text{sec}] \quad (3).$$

4. The ignition device according to claim 1, wherein in jetting the plasma from the plasma jet ignition plug one time, using a time (Tb) at which the spark discharge is generated due to dielectric breakdown in the spark discharge gap caused by the application of voltage using the discharge voltage applying unit as a start point, and assuming a time period, which elapses until a value of an electric current which flows into the spark discharge gap along with the supply of the energy from the energy supply unit assumes a maximum value I [A] from the start point, as t2 [sec], a following formula (4) is satisfied:

$$t2 \leqq 150\ [\mu\text{sec}] \quad (4).$$

5. The ignition device according to claim 1, wherein in jetting the plasma from the plasma jet ignition plug one time, using a time (Te) at which the supply of energy to the spark discharge gap from the energy supply unit is started as a start point; and assuming a time period, which elapses until a value of an electric current which flows into the spark discharge gap assumes a maximum value I [A] along with the supply of the energy from the start point, as t1 [sec]; and assuming a time period, which elapses until the supply of energy from the energy supply unit is finished, as t3 [sec], a following formula (5) is satisfied:

$$t1/t3 \leqq 3/5 \quad (5).$$

* * * * *